US010941561B2

(12) United States Patent
Miller

(10) Patent No.: US 10,941,561 B2
(45) Date of Patent: Mar. 9, 2021

(54) PREFABRICATED MODULAR BUILDINGS

(71) Applicant: RAD Urban Inc., Oakland, CA (US)

(72) Inventor: Randall Miller, Orinda, CA (US)

(73) Assignee: RAD URBAN, LLC, Walnut Creek, CA (US)

( * ) Notice: Subject to any disclaimer, the term of this patent is extended or adjusted under 35 U.S.C. 154(b) by 0 days.

(21) Appl. No.: 16/047,291

(22) Filed: Jul. 27, 2018

(65) Prior Publication Data

US 2019/0032328 A1 Jan. 31, 2019

Related U.S. Application Data

(60) Provisional application No. 62/537,713, filed on Jul. 27, 2017, provisional application No. 62/537,717, filed on Jul. 27, 2017.

(51) Int. Cl.

| | |
|---|---|
| ***E04B 1/348*** | (2006.01) |
| ***E04F 13/08*** | (2006.01) |
| ***E04G 21/14*** | (2006.01) |
| ***E04H 1/04*** | (2006.01) |
| ***E04H 1/00*** | (2006.01) |
| ***E04B 1/41*** | (2006.01) |
| ***E04B 2/88*** | (2006.01) |
| *E04B 1/38* | (2006.01) |

(52) U.S. Cl.

CPC ..... *E04B 1/34861* (2013.01); *E04B 1/3483* (2013.01); *E04B 1/34815* (2013.01); *E04B 1/40* (2013.01); *E04B 2/88* (2013.01); *E04F 13/0855* (2013.01); *E04G 21/142* (2013.01); *E04H 1/00* (2013.01); *E04H 1/04* (2013.01); *E04B 2001/34892* (2013.01); *E04B 2001/405* (2013.01)

(58) Field of Classification Search

CPC ..... E04B 1/34861; E04B 1/3483; E04B 2/88; E04B 1/34815; E04B 1/40; E04B 2001/34892; E04B 2001/405; E04G 21/142; E04H 1/04; E04H 1/00

See application file for complete search history.

(56) References Cited

U.S. PATENT DOCUMENTS

| | | | |
|---|---|---|---|
| 2,037,895 A | 4/1936 | Gugler | |
| 2,990,588 A | 7/1961 | McKinley | |

(Continued)

FOREIGN PATENT DOCUMENTS

| | | | |
|---|---|---|---|
| CN | 204527557 U | 8/2015 | |
| DE | 4412505 C1 * | 6/1995 | ..... E04F 13/0808 |

(Continued)

OTHER PUBLICATIONS

Non-Final Office Action in related U.S. Appl. No. 16/047,282 dated Feb. 25, 2019.

(Continued)

*Primary Examiner* — Jessie T Fonseca

(74) *Attorney, Agent, or Firm* — Foley & Lardner LLP

(57) ABSTRACT

The present application relates to a volumetric module constructed from a module chassis, an exterior wall attached to at least a portion of the module chassis, a floor assembly attached to at least a portion of the module chassis, and a façade adjustably attached to at least a portion of the module chassis. The volumetric module may be configured to interface with a separate accommodation module.

10 Claims, 10 Drawing Sheets

(56) References Cited

U.S. PATENT DOCUMENTS

| | | | | |
|---|---|---|---|---|
| 3,077,960 | A | 2/1963 | Lang | |
| 3,447,503 | A | 6/1969 | Myers | |
| 3,500,595 | A | 3/1970 | Bennett | |
| 3,525,186 | A | 8/1970 | Lombardo | |
| 3,541,744 | A | 11/1970 | Maxwell | |
| 3,638,380 | A | 2/1972 | Perri | |
| 3,712,008 | A | 1/1973 | Georgiev et al. | |
| 3,721,056 | A | 3/1973 | Toan | |
| 3,742,660 | A * | 7/1973 | Bierweiler | E04B 1/34823 52/79.13 |
| 3,758,998 | A | 9/1973 | Ollis et al. | |
| 3,805,461 | A * | 4/1974 | Jagoda | E04B 1/34823 52/79.11 |
| 3,823,520 | A | 7/1974 | Ohta et al. | |
| 3,882,649 | A * | 5/1975 | Mah | E04B 1/20 52/79.9 |
| 3,894,373 | A | 7/1975 | Willingham | |
| 3,991,528 | A * | 11/1976 | Dillon | E04B 1/34823 52/79.9 |
| 4,059,931 | A | 11/1977 | Mongan | |
| 4,102,097 | A | 7/1978 | Zalotay | |
| 4,194,339 | A * | 3/1980 | Fisher | E04B 1/34823 52/223.1 |
| 4,513,545 | A * | 4/1985 | Hopkins, Jr. | E04B 1/348 52/745.03 |
| 4,525,975 | A | 7/1985 | McWethy | |
| 4,545,159 | A * | 10/1985 | Rizk | E04B 1/3483 52/143 |
| 4,723,381 | A | 2/1988 | Straumsnes | |
| 4,766,708 | A | 8/1988 | Sing | |
| 5,400,550 | A | 3/1995 | Beasley | |
| 5,402,608 | A | 4/1995 | Chu | |
| 5,528,866 | A | 6/1996 | Yulkowski | |
| 5,644,871 | A | 7/1997 | Cohen et al. | |
| 6,016,636 | A | 1/2000 | Caputo | |
| 6,826,879 | B1 | 12/2004 | Allen et al. | |
| 6,925,761 | B1 | 8/2005 | De La Marche | |
| 7,047,897 | B2 | 5/2006 | Eloranta et al. | |
| 7,827,738 | B2 | 11/2010 | Abrams et al. | |
| 7,921,609 | B2 | 4/2011 | Kordelin | |
| 8,166,714 | B2 | 5/2012 | Ziegelman | |
| 8,621,787 | B2 | 1/2014 | Barry et al. | |
| 9,068,340 | B2 | 6/2015 | Austin et al. | |
| 9,556,632 | B2 | 1/2017 | Malakauskas et al. | |
| 9,663,937 | B2 | 5/2017 | Goldman | |
| 10,538,388 | B2 | 1/2020 | Clarke et al. | |
| 2003/0041555 | A1 | 3/2003 | Scallan et al. | |
| 2003/0101680 | A1 | 6/2003 | Lee | |
| 2003/0136062 | A1 | 7/2003 | Gunthardt | |
| 2007/0144079 | A1 | 6/2007 | Hourihan | |
| 2007/0271857 | A1 | 11/2007 | Heather et al. | |
| 2008/0134589 | A1 | 6/2008 | Abrams et al. | |
| 2010/0058675 | A1 | 3/2010 | Simmons | |
| 2010/0107517 | A1 * | 5/2010 | Smith | E04B 1/34336 52/127.2 |
| 2012/0240482 | A1 | 9/2012 | Pitt et al. | |
| 2013/0305629 | A1 | 11/2013 | Stephenson et al. | |
| 2014/0123573 | A1 | 5/2014 | Farnsworth | |
| 2016/0002909 | A1 | 1/2016 | Bowron et al. | |
| 2016/0122997 | A1 | 5/2016 | Smith | |
| 2016/0312485 | A1 | 10/2016 | Wilson et al. | |
| 2017/0089060 | A1 | 3/2017 | Harper | |

FOREIGN PATENT DOCUMENTS

| | | | | |
|---|---|---|---|---|
| DE | 19637549 | C1 | 1/1998 | |
| DE | 10005872 | C1 * | 7/2001 | E04B 1/3483 |
| DE | 102004048610 | A1 | 4/2006 | |
| FR | 2681087 | A1 * | 3/1993 | E04F 13/0855 |
| WO | WO-2005090706 | A1 * | 9/2005 | E04F 13/0855 |
| WO | 2011117675 | A1 | 9/2011 | |

OTHER PUBLICATIONS

International Search Report and Written Opinion in related International Application No. PCT/US2018/044142 dated Sep. 26, 2018.

International Search Report and Written Opinion in related International Application No. PCT/US2018/044131 dated Sep. 26, 2018.

Deltec Homes, Prefab vs. Modular vs. Panelized, as viewed on Jul. 25, 2018. "https://www.deltechomes.com/prefab-is-modular-vs-panelized/".

TC MAXIs, Prefabricated Cabin Unit System, as viewed on Jul. 25, 2018. "http://www.tcmaxis.com/wp-content/uploads/2011/04/Staco-Prefabricated-Cabins.pdf".

* cited by examiner

PREFABRICATED MODULAR BUILDINGS

CROSS-REFERENCE OF RELATED APPLICATION

This application claims priority to U.S. Provisional Patent Application No. 62/537,717, filed on Jul. 27, 2017 and to U.S. Provisional Patent Application No. 62/537,713, filed on Jul. 27, 2017, the entire contents of each are hereby incorporated by reference.

FIELD OF THE INVENTION

The present invention relates to a volumetric module, a modular space, and methods of manufacturing the like.

BACKGROUND OF THE INVENTION

Modular fabrication techniques are becoming more commonplace as parties seek cost and time effective approaches to building dwelling spaces. Some examples of existing modular structures include volumetric modules built from wood or light gauge steel, modules fabricated from containers (e.g., shipping containers), and flat panel (flat-pack) modules. Volumetric modules using wood or light gauge steel are often not structurally sufficient for larger dwelling structures, such as tall buildings, and the like. For example, wood may limit construction to a maximum of five floors and light gauge steel may limit a structure to 10 floors. Using containers, such as shipping containers, as modules may also limit the size of a structure, thereby limiting their use to small houses and affordable housing structures. Flat panel modules require significant assembly at the work site.

BRIEF SUMMARY OF THE INVENTION

According to an exemplary embodiment, a volumetric module may be constructed from a module chassis, an exterior wall attached to at least a portion of the module chassis, a floor assembly attached to at least a portion of the module chassis, and a façade adjustably attached to at least a portion of the module chassis. The volumetric module may be configured to interface with a separate accommodation module.

According to an exemplary embodiment, a modular space may be constructed from a plurality of volumetric modules. The plurality of volumetric modules are adjustably connected to one another by a module to module connector. Each of the plurality of volumetric modules may be constructed from a module chassis, an exterior wall attached to at least a portion of the module chassis, and a floor assembly attached to at least a portion of the module chassis. At least one of the plurality of volumetric modules is configured to interface with a separate accommodation module.

According to an exemplary embodiment, a method for assembling a modular space includes assembling a plurality of volumetric modules, adjustably attaching a façade to at least one of the plurality of volumetric modules, and adjustably connecting the plurality of volumetric modules to one another to form a frame for the modular space.

According to an exemplary embodiment, a bracket assembly for adjustably attaching a façade to a module chassis is described. A first bracket of the assembly is fastened to the façade and a second bracket is fastened to the module chassis. The first and second brackets are adjustably attached such that the first bracket and second bracket translate relative to one another. In an embodiment, the bracket assembly is also configured to have translational motion along multiple planes in a three-dimensional space.

According to an exemplary embodiment, an module-to-module attachment system is described. The attachment system includes a first eccentric bushing having a rotatable core; a second eccentric bushing having a rotatable core; and a fastening member. The rotatable core of the first eccentric bushing is configured to accept the second eccentric bushing, and the rotatable core of the second eccentric bushing is configured to accept the fastening member.

DESCRIPTION OF THE FIGURES

Exemplary embodiments are described in greater detail below with reference to the accompanying drawings, in which.

DETAILED DESCRIPTION OF THE INVENTION

Figure 1:
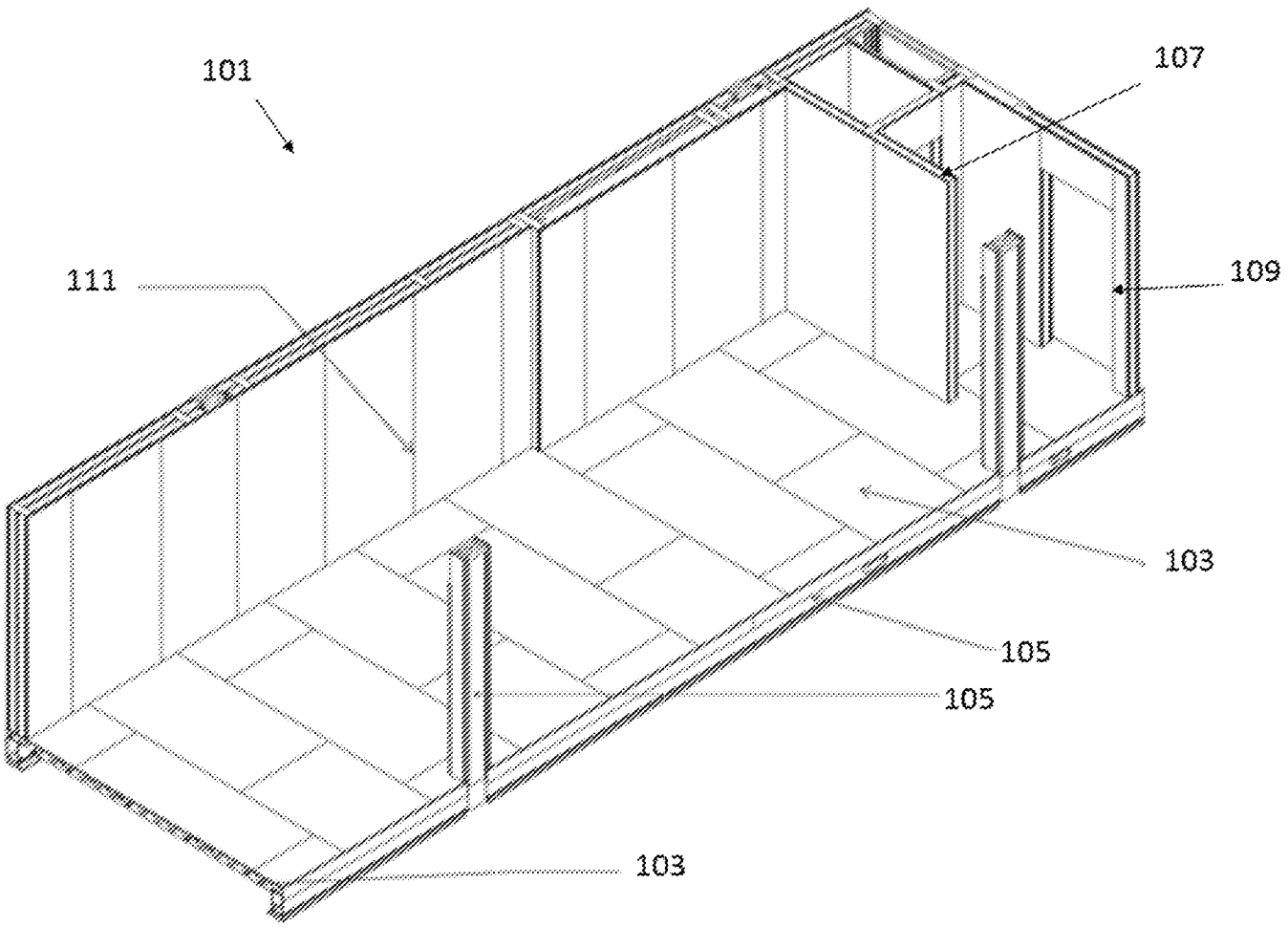
FIG. 1 is a perspective view of an exemplary volumetric module according to an embodiment.

Some embodiments of the current invention are discussed in detail below. In describing the embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections are incorporated as if each had been individually incorporated.

The terms "volumetric module," "volumetric building module," and "accommodation module" are used interchangeably throughout. The terms "module to module connector" and "module to module connection assembly" are used interchangeably throughout.

As used throughout, the term "module chassis" refers to a base or framework for a volumetric building module.

Disclosed herein are apparatuses and methods of manufacturing buildings, such as single family houses, multi-family apartments, commercial buildings, high-rises and the like. The techniques disclosed herein are applicable to modular construction, manufacturing of dwellings, manufacturing of commercial buildings, and various other manufacturing environments.

An exemplary embodiment of a volumetric module includes a module chassis, an exterior wall attached to at least a portion of the module chassis, a floor assembly attached to at least a portion of the module chassis, and a façade adjustably attached to at least a portion of the module chassis. The volumetric module is configured to interface with a separate accommodation module.

In another exemplary embodiment, a volumetric module includes a bracket assembly attached to the module. A façade is attached to the module chassis via the bracket assembly, which facilitates adjustment of the façade during construction. The bracket assembly may be configured to have translational motion along multiple planes in a three-dimensional space or along all planes in a three-dimensional space.

An exemplary embodiment includes a volumetric module having at least three exterior walls attached to the module chassis.

An exemplary embodiment includes a volumetric module, where a maximum of three exterior walls are attached to a module chassis. In such an embodiment, the maximum of three exterior walls are configured such that at least one side of the module chassis remains unobstructed by the three exterior walls. In addition, the module chassis has an open top portion such that the top portion of the module chassis remains unobstructed. In certain cases, when the volumetric modules are stacked, the floor of a volumetric module above is the ceiling of the volumetric module below. Such a configuration may reduce production by saving material.

An exemplary embodiment includes a volumetric module further including an interior wall attached to a module chassis. In some embodiments, the interior wall and the volumetric module also include all mechanical, electrical and plumbing systems; non-limiting examples include heating ventilation and air conditioning ducting, dampers, air terminal devices and heat exchanging unit. Some embodiments also include in the unit all plumbing fixtures including, but not limited to, to lavatory, water closet, shower, urinal, kitchen sink, laundry, plumbing faucets etc. In some embodiments, the volumetric module also contains electrical fixtures and appliances, electrical wiring, electrical panels, smoke sensors, electrical module to module connections etc. In some embodiments, the volumetric module also contains doors, windows, façade.

An exemplary embodiment includes a volumetric module having an interior wall with a doorway.

An exemplary embodiment includes a volumetric module having at least one exterior wall or a floor assembly which includes a protective material.

An exemplary embodiment includes a volumetric module having at least one exterior wall or a floor assembly which includes a protective material. The protective material is at least one of a fire resistant material and a water proof material.

An exemplary embodiment includes a volumetric module, where the floor assembly includes at least one of a joint protective material, a panelized material, a corrugated metal floor deck, and a fiberglass.

An exemplary embodiment includes a volumetric module having a module chassis made up of a plurality of vertical structural support members and a plurality of horizontal structural support members, such that an end of each of the plurality of vertical structural support members is attached to a portion of at least one of the horizontal structural support members.

An exemplary embodiment includes a modular space having a plurality of volumetric modules. The plurality of volumetric modules are adjustably connected to one another by a module to module connector. Each of the plurality of volumetric modules includes a module chassis, an exterior wall attached to at least a portion of the module chassis, and a floor assembly attached to at least a portion of the module chassis. In addition, at least one of the plurality of volumetric modules is configured to interface with an accommodation module.

An exemplary embodiment includes a modular space having a plurality of volumetric modules, where at least one of the plurality of volumetric modules further includes a façade attached to a module chassis.

An exemplary embodiment includes a modular space having a plurality of volumetric modules and further including a bracket assembly. A façade is attached to a module chassis in an adjustable manner by the bracket assembly.

An exemplary embodiment includes a modular space having a plurality of volumetric modules and having a bracket assembly configured to have translational motion along multiple planes in a three-dimensional space.

An exemplary embodiment includes a modular space having a plurality of volumetric modules and having a bracket assembly configured to have translational motion along all planes in a three-dimensional space.

An exemplary embodiment includes a modular space having a plurality of volumetric modules and having a module to module connector which includes an eccentric bushing.

An exemplary embodiment includes a modular space having a plurality of volumetric modules, further including a telescoping duct assembly between at least two of the plurality of volumetric modules.

An exemplary embodiment includes a modular space having a plurality of volumetric modules, where at least two of the plurality of volumetric modules each include a flexible module to module connection configured to contain a telescoping duct assembly.

An exemplary embodiment includes a modular space having a plurality of volumetric modules, where at least three exterior walls are attached to a module chassis.

An exemplary embodiment includes a modular space having a plurality of volumetric modules and also having an interior wall attached to a module chassis.

An exemplary embodiment includes a modular space having a plurality of volumetric modules and also having an interior wall that forms a doorway.

An exemplary embodiment includes a modular space having a plurality of volumetric modules and also having at least one exterior wall or a floor assembly having a protective material.

An exemplary embodiment includes a modular space having a plurality of volumetric modules and also having at least one exterior wall or a floor assembly having a protective material. The protective material is at least one of a fire resistant material and a water proof material.

An exemplary embodiment includes a modular space having a plurality of volumetric modules and also having a floor assembly which includes at least one of a joint protective material, a panelized material, a corrugated metal floor deck, and a fiberglass.

An exemplary embodiment includes a modular space having a plurality of volumetric modules, where the modular space is at least 5 stories tall.

An exemplary embodiment includes a modular space having a plurality of volumetric modules, where the modular space is at least 10 stories tall.

An exemplary embodiment includes a modular space having a plurality of volumetric modules and having a maximum of three exterior walls attached to a module chassis. In such an embodiment, the maximum of three exterior walls are configured such that at least one side of the module chassis remains unobstructed by the maximum of three exterior walls. In addition, the module chassis does not include a top panel or roof such that a top portion of the module chassis remains unobstructed. In such embodiments, the floor assembly of the module acts as the ceiling for a module stacked below it.

An exemplary embodiment includes a method for assembling a modular space, the method including assembling a plurality of volumetric modules, adjustably attaching a façade to at least one of the plurality of volumetric modules, and adjustably connecting the plurality of volumetric modules to one another to form a frame for the modular space.

An exemplary embodiment includes a method for assembling a modular space, including a step of adjustably attaching a façade to at least one of a plurality of volumetric modules where a bracket assembly is provided. The bracket assembly adjustably attaches the façade to the at least one of the plurality of volumetric modules.

An exemplary embodiment includes a method for assembling a modular space having a plurality of volumetric modules including a step of adjustably connecting a plurality of volumetric modules to one another by providing a module to module connector. The module to module connector adjustably attaches the plurality of volumetric modules to one another.

An exemplary embodiment includes a method for assembling a modular space having a plurality of volumetric modules including a module to module connector having an eccentric bushing. An exemplary embodiment includes a method for assembling a modular space having a plurality of volumetric modules, including a step of assembling a plurality of volumetric modules by providing a module chassis, attaching an exterior wall to at least a portion of a module chassis, and attaching a floor assembly to at least a portion of the module chassis.

According to an exemplary embodiment, a bracket assembly for adjustably attaching a façade to a module chassis is described. Such a bracket assembly includes a first bracket fastened to the façade and a second bracket fastened to the module chassis. The first and second brackets are adjustably attached such that the first bracket and second bracket translate relative to one another. In certain cases, translation of the first bracket and second bracket is controlled by adjustment of one or more lead screws. In certain cases, such a bracket assembly may include one or more aluminum brackets. In some embodiments, the bracket assembly is configured to have translational motion along multiple planes in a three-dimensional space.

According to an exemplary embodiment, a module-to-module connection system is described. The module-to-module connection system may include a plurality of volumetric modules connected by a plurality of eccentric bushing assemblies. The eccentric bushing assemblies may include a first eccentric bushing comprising a rotatable core, a second eccentric bushing comprising a rotatable core, and a fastening member. The rotatable core of the first eccentric bushing may be configured to accept the second eccentric bushing, and the rotatable core of the second eccentric bushing is configured to accept the fastening member.

FIG. 1 depicts a volumetric module 101 according to an embodiment of the invention. In the example shown, a volumetric module 101 may include a four-sided (e.g., open on the top and the side) volumetric building module. Such a volumetric module is a component of the prefabricated modular construction process. One of ordinary skill in the art can envision that volumetric modules described herein can adopt a variety of geometric shapes and forms (e.g. square, rectangular, circular, etc.) Depending on the type of structure, a volumetric module may include a floor assembly 103, structural support members 105, interior wall(s) 107, doorways 109, exterior wall(s) 111, and/or other features. Use of open top and open side volumetric building modules reduces costs by eliminating redundancy in the structure of the module, thereby reducing the cost of the module. Eliminating redundancy in the structure also reduces transportation costs, which are proportional to the weight, geometry, and other features of the module. Stacking modules that are open top and open side prevent wall-wall redundancy and ceiling-floor redundancy. For example, as two L-shaped volumetric modules are bolted together the single common wall results in forming two enclosed spaces. Similarly, when the open top volumetric modules are stacked, the floor of one module "doubles up" (also functions as) the ceiling of the module below it, resulting in two enclosed spaces. Employing common walls amongst adjacent modules results in usage of less material and increased ceiling height per floor of a building. Use of volumetric building modules, according to various embodiments, reduces the number of elements/parts that need to be manufactured, thus improving speed and reducing time of manufacturing.

Figure 2:
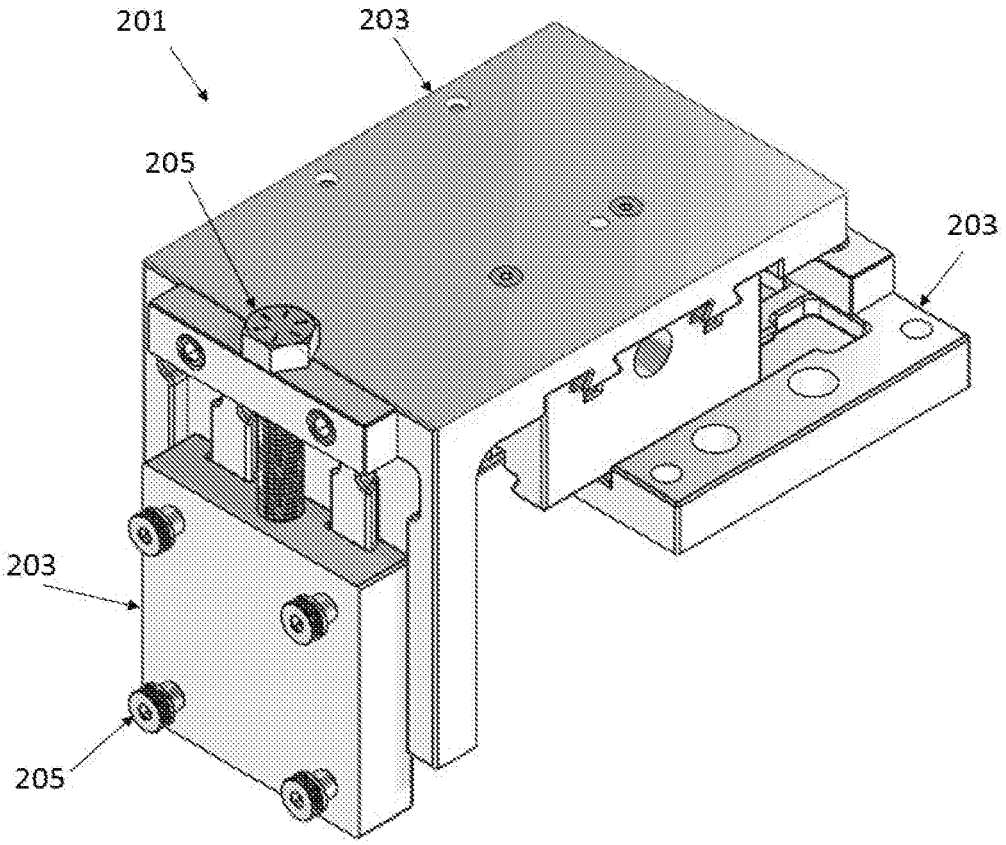
FIG. 2 is a perspective view of an exemplary bracket assembly according to an embodiment.

FIG. 2 depicts a bracket assembly 201 according to an embodiment of the invention. In the example shown, a bracket assembly 201 attaches the façade of volumetric module to the module chassis. In certain cases, brackets 203 and fastening members 205 connect the façade to the bracket assembly, the bracket assembly to the volumetric building module and/or the bracket assembly to itself. For example, one bracket 203 may be attached to the façade and another bracket 203 may be attached to the module chassis. The bracket assembly 201 may improve the performance, accuracy, and cost of the attachment between the façade and module chassis. For example, performance is increased because the brackets 203 has translational motion along all planes in three-dimensional space allowing the dry seal gaskets in the façade system (not shown) to engage. This may, for example, allow the modules to be "water-proofed" immediately upon installation, which reduces risk of damage. An adjustable assembly 201 also accurately aligns the façade with the chassis and adjacent blocks giving the façade a "complete" look. The brackets 203 also reduce cost by allowing for "play" during assembly to eliminate the need for precision manufacturing.

In certain cases, brackets 203 seated on a channel are moved across the face of one and another by adjusting fastening members 207 (e.g., a lead screw). Twisting (e.g., tightening or loosening) of fastening members 207 moves or translates the brackets 203. By moving the brackets 203, the bracket assembly 201 can be used to adjust the position of a façade relative to the module and/or other façades. Adjusting the façade relative to the module allows a façade a module to be aligned with adjacent façades improving the external appearance of the building. For example, if one volumetric module is larger than another due to variations in manufacture or misaligned in the stack of modules during assembly, the fastening member 207 can be adjusted to compensate. For example, the locations of adjacent façades may be adjusted to be in line with each other even when the modules attached to the façades are misaligned. The bracket assembly 201 is configured to accommodate variations in volumetric module geometry and placement. Allowing for variable in assembly allows components to be manufactured at costs that permit use in cost-restricted construction projects.

In various embodiments, the bracket assembly 201 allows a façade to be attached to a module during manufacturing, as opposed to at a building construction site. The façade may be attached to a module at during manufacturing and transferred to the building site for installation as a unit. At the building side, the module and façade are attached to adjacent modules, for example, by stacking the module on an adjacent module. The bracket assembly 201 is then adjusted to mate the façade to the façades of adjacent modules.

Figure 3:
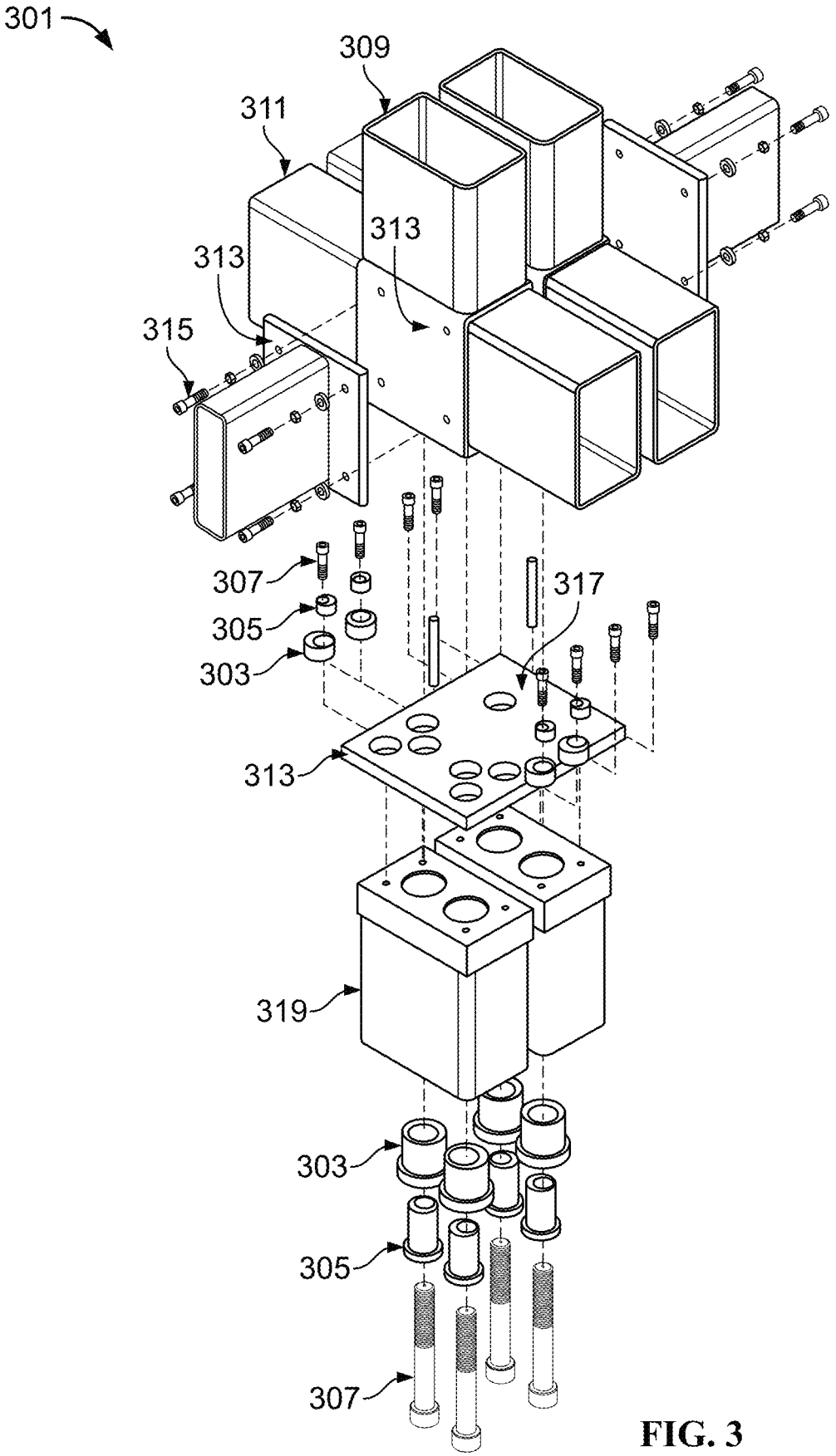
FIG. 3 depicts an exemplary embodiment of a structural module connection including eccentric bushings according to an embodiment.

FIG. 3 depicts a module-to-module connection according to various embodiments. In the example shown, a module-to-module connection 301 adjoins columns 309 and beams 311 of adjacent modules. The module-to-module connection 301 is capable of adjusting to accommodate for slight misalignments between modules. The module-to-module connection 301 may include eccentric outer bushings 303, eccentric inner bushings 305, fastening members 307, plates 313, and/or other components. In an exemplary embodiment, columns 309 and/or beams 311 of adjacent modules are attached to a plate 313 by fasteners 307. To allow for adjustability, the fasteners 307 are installed in eccentric bushings 303, 305. For example, a first eccentric bushing 303 may include an opening that can accommodate a second eccentric bushing 305. A fastener 307 is inserted into the rotatable core of the second eccentric bushing 205. The first bushing 303 and second bushing 305 may be rotated relative to one another, a plate 313, and/or other components to adjust the alignment of the fasteners 307. The fasteners 307 can be adjusted in the eccentric bushings 303, 305 to accommodate misalignments between the plate 313 as well as the columns 309 and beams 311 of adjacent modules. For example, the fasteners 307 can be adjusted in the eccentric bushings 303, 305 hole patterns in the plate 313, columns 309, and beams 311. This allows for increased variability in the positioning of adjacent modules. In certain cases, alignment pins 315 may be used to aid in alignment of the plate 313 to the columns 309 and beams 311 of adjoining modules. Such a method for connecting adjacent modules for the purpose of constructing a building was previously unforeseen as it was not believed that such a connection could be designed to provide enough structural support for a building.

In some embodiments, the bracket assembly of FIG. 3 includes a 10-way, structural module-to-module connection with a steel plate. In such cases, the module-to-module assembly 301 includes brackets and fastening members for connecting adjacent modules. Such a bracket assembly can increase the performance, accuracy, and speed of manufacturing. For example, the module-to-module assembly 301 allows for a more robust structural construction by allowing increased diaphragm shear capacity, which is important for taller buildings. The module-to-module assembly 301 also allows for manufacturing with relatively low tolerance requirements, thereby reducing cost. The eccentric bushings 303, 305 with rotatable cores allow for increased scope/margin for misalignment. This results in less rework on-site, less stringent tolerance requirements in manufacturing, and increased installation speed on-site. All of the features above contribute to lower costs. In an embodiment, the 10-way connection between adjacent modules brings together vertical, diagonal and/or horizontal beam members 311 of each modular chassis. The connection between modules is made at a connection point or joint via the use of a module-to-module connection having eccentric bushings, which allow for adjustments and alignments to be made on-site during the assembly process to account for misalignments between adjacent modules. The 10-way connection allows for 4 steel columns and 6 steel beams to be connected forming a building from individual modules.

Figure 4:
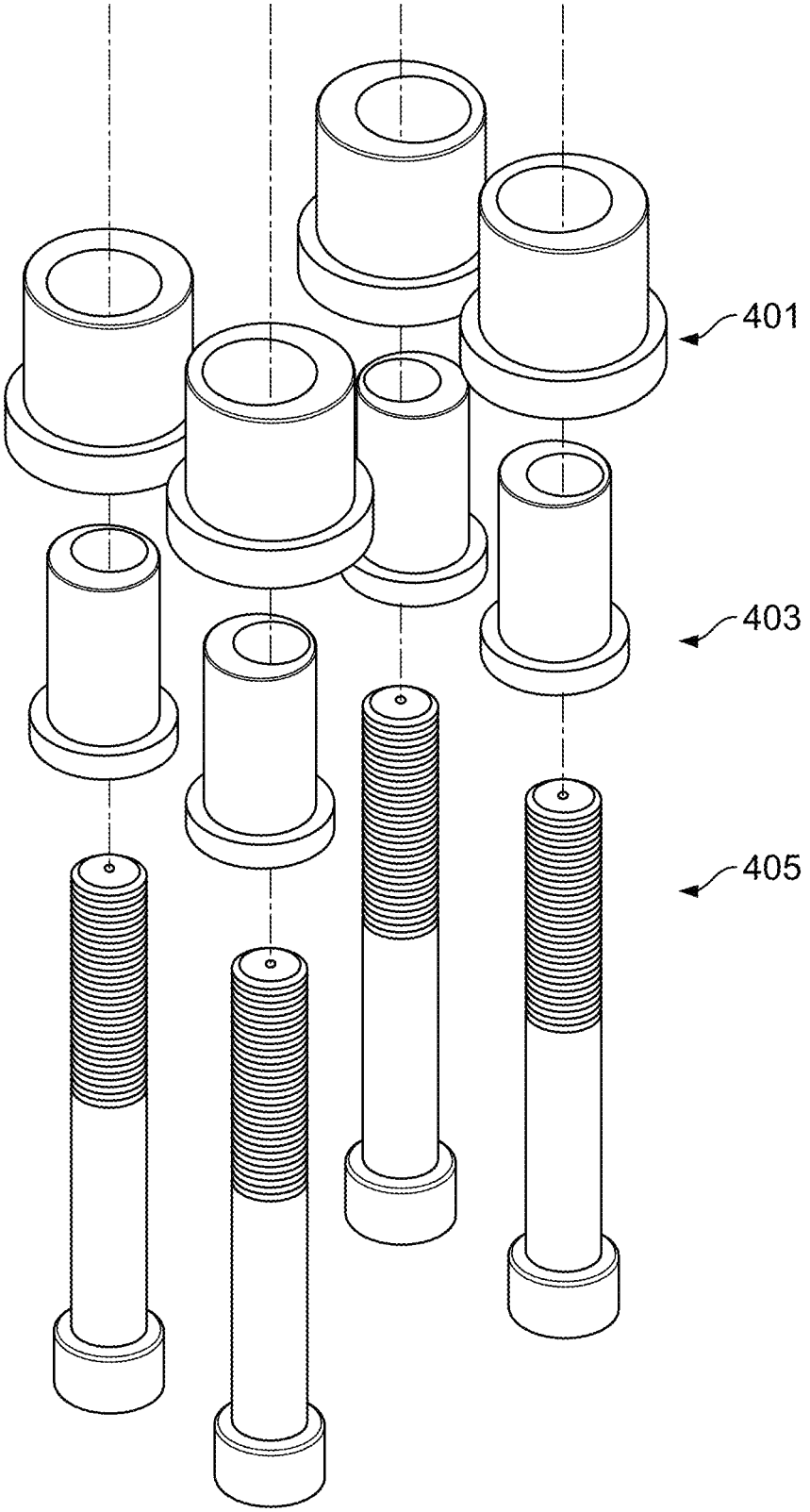
FIG. 4 depicts an exemplary embodiment of eccentric bushings and a fastener according to an embodiment.

FIG. 4 depicts an assembly of fasteners installed in eccentric bushings. In the example shown, fasteners are installed in first and second eccentric bushings 401, 403. In the embodiment depicted, a first (or exterior or outer) eccentric bushing 401 has an opening that can accommodate a second (or inner) eccentric busing 403. The second eccentric bushing 403 is rotatable relative to the first eccentric bushing 403. A fastener 405 passes through an opening in the first and second eccentric bushings. The first eccentric bushing 401 and second eccentric 403 may be rotated to adjust the alignment of the fastener 405. Rotation of the first eccentric bushing 401 and second eccentric 403 allow the alignment of the fastener 405 to be adjusted to line up to holes in other parts, such as plates, brackets, or other components. A module to module connection (e.g., module-to-module connection 301 of FIG. 3) including eccentric bushings 401, 403 can be adjusted to accommodate geometric variances between two mating volumetric modules. For example, fasteners 405 may be aligned with hole patterns in plates and/or brackets by rotating the first eccentric bushing 401 and second eccentric bushing 403. A fastener 405 is inserted into the rotatable inner core of the inner busing (e.g., second eccentric bushing 403). The rotatable core can be moved in the exterior bushing (e.g., first eccentric bushing 401) in order to mitigate any misalignments between the connecting columns, such as columns 309 of FIG. 3. This allows for increased tolerance to misalignments between adjacent modules. Such a method for connecting adjacent modules for the purpose of constructing a building was previously unforeseen as it was not believed that such a connection could be designed to provide enough structural support for a building.

In some embodiments, many different connections and/or joints between modules, façades, and other components may include eccentric bushings. Eccentric bushings can include a "rotatable" core to ensure that a large hole can be fit with a bolt, which can be rotated to ensure proper alignment with structure of adjacent modules. Use of eccentric bushing results in increased performance, speed, and cost. Performance can be increased as the "rotatable" interior core ensures that tight tolerances can be achieved without requiring post production modifications to the structure. Speed of manufacture is increased as larger holes can accommodate moving bushings allowing for faster and easier manufacturing and installations. Cost is reduced because eccentric bushings allow for increased slip critical connections saving the cost of a washer plate (e.g., 1 inch steel) and also eliminates the need to drill holes on site. The eccentric bushings have rotatable openings that allow for an adjustable connection at a connection point or joint between adjacent modules to be made with a fastening member (e.g. a screw, a bolt, a rivet, etc.). Unlike traditional set-openings or holes for accepting fasteners, the rotatable nature of the opening of the eccentric bushings allows for tolerance of a degree misalignment at a connection point or joint between adjacent modules. This property allows for two adjacent modules to be bolted together at a connection point or joint even if the alignment between the adjacent modules is not precise.

Figure 5:
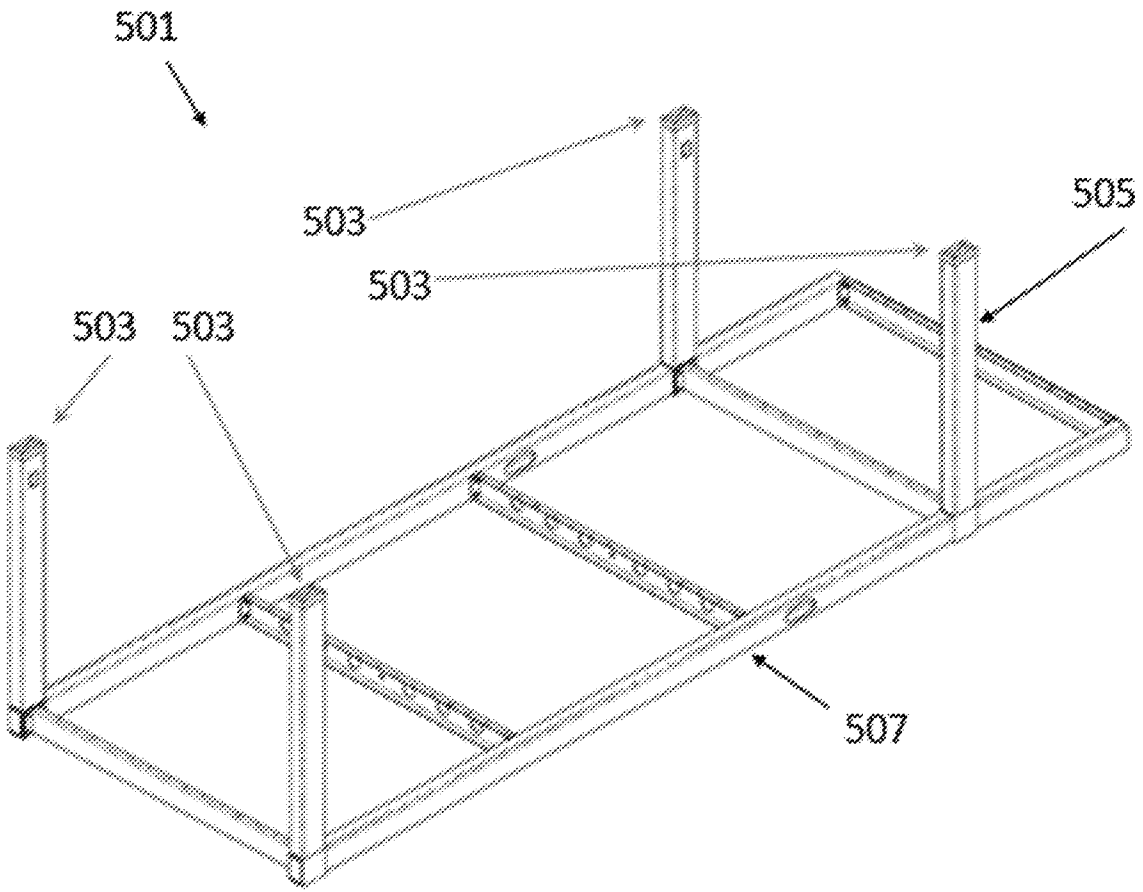
FIG. 5 depicts an exemplary perspective view of a module chassis according to an embodiment.

FIG. 5 depicts a perspective view of a module chassis 501 according to some embodiments of the invention. The module chassis of FIG. 5 includes module pick-points 503, a plurality of vertical structural support members 505, a plurality of horizontal structural support members 507, and/or other components. The vertical and horizontal structural support members are connected to form the module chassis 501. In addition, these vertical and horizontal structural support members are configured to interact with additional components such as exterior walls, floor assemblies and a façade. The module pick-points are configured to interact with a hoisting frame or crane for lifting (or otherwise moving) the module during assembly of a modular building.

Figure 6:
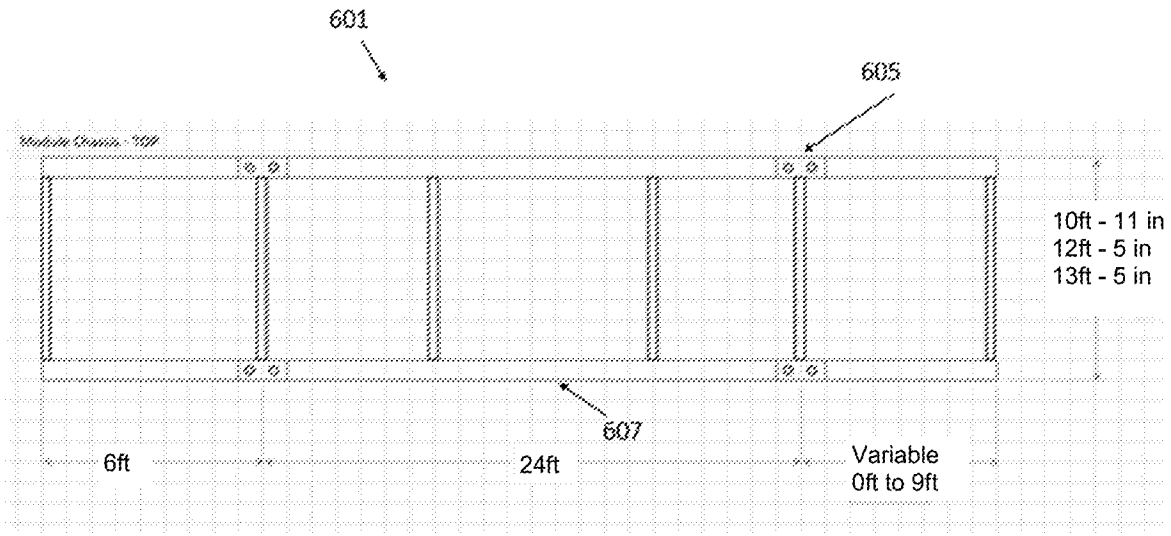
FIG. 6 depicts a top view of an exemplary module chassis according to an embodiment.

FIG. 6 depicts a top view of the module chassis according an exemplary embodiment. The module chassis of FIG. 6 includes a plurality of vertical structural support members 605 and a plurality of horizontal structural support members 607. The vertical and horizontal structural support members are connected to form the module chassis 601. In addition, these vertical and horizontal structural support members are configured to interact with additional components such as exterior walls, floor assemblies and a façade.

In reference to FIGS. 5-6, an exemplary module chassis includes multiple pick points. The modules can be lifted by the module pick points using, for example, a hoisting frame. The hoisting frame/crane may include a self-leveling crane system, which provides speed, cost, and time-saving advantages. Connecting at module pick points allows for increased speed for lifting modules. A shallow hoisting rig may redistribute load with a shorter crane allowing reduction in crane expenses. A remote release on the crane allows releasing of the module in position without manual intervention saving critical time in setting modules.

In various embodiments, surveying equipment may be used to place a module in a building structure. Surveying equipment may be used to determine where modules are to be set. The surveying equipment and/or placement location may be guided by a module setting grid. Maneuvering a crane based on precisely measured coordinates (e.g., as determined by surveying equipment) allows for rapid assembly while avoiding module damage and/or resetting costs. Maneuvering a crane based on precisely measured coordinates may also allow for accurate placement of modules ensuring good quality finishing of a building.

Figure 7:
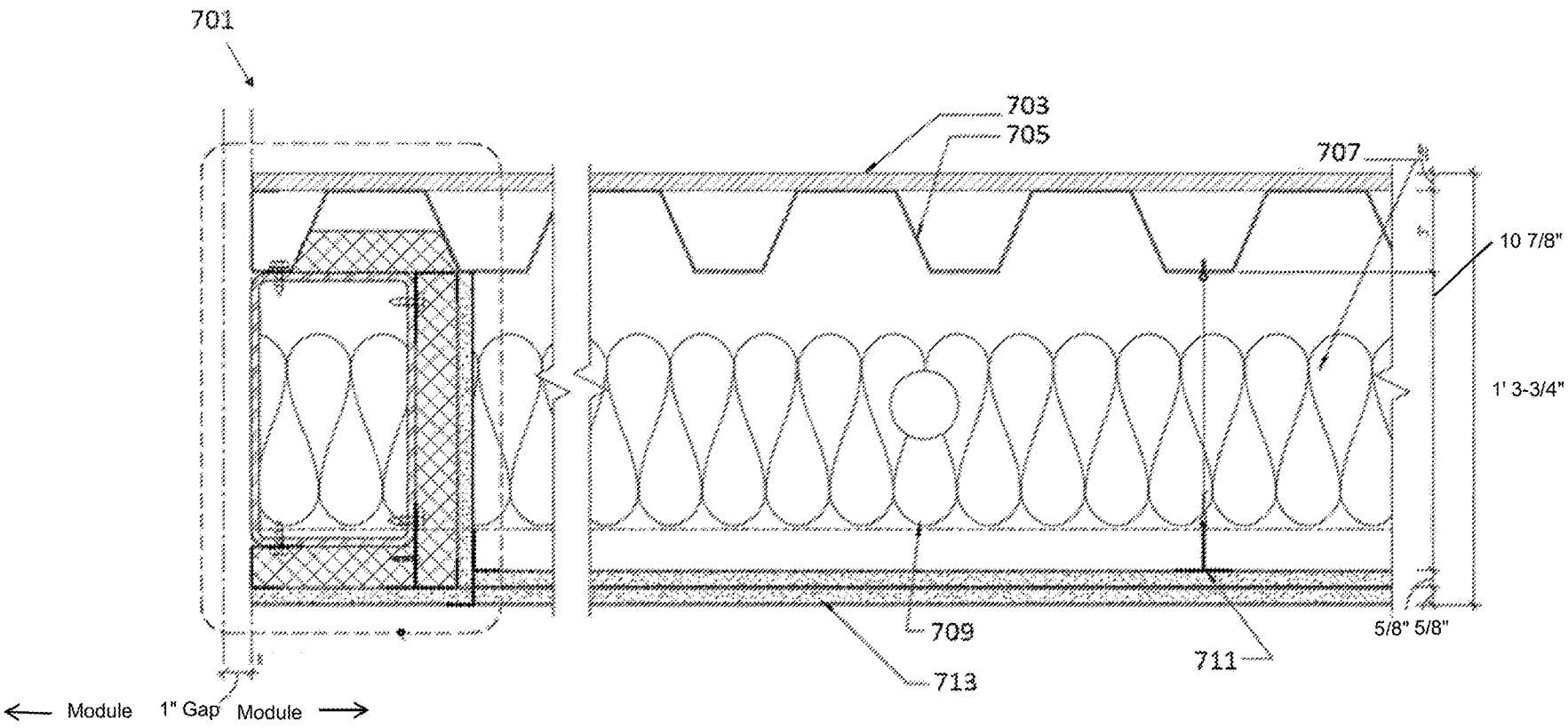
FIG. 7 is a cross-sectional view of an exemplary floor assembly according to an embodiment.

FIG. 7 is a cross-sectional view of an exemplary embodiment of a floor assembly 701, shown in cross-section. The floor assembly may include joint protective material, panelized material, a corrugated metal floor deck, fiberglass, and/or other elements. The joint protective material allows the structure to satisfy fire ratings applicable to conventional buildings, thereby satisfying applicable building codes. Panelized material (such as Gypsum board) may also allow the structure to meet fire rating requirements. Use of panelized material to meet fire rating requirements prevents the need for concrete in the metal decking (as is often used in traditional buildings), thereby saving material and transportation costs. Fire rating requirements are thus satisfied with reduced material and lower cost. In an embodiment, the floor assembly is made of steel units to provide increased structural support for the modular building. In an exemplary embodiment, to save resources and reduce redundancy during construction of a modular space or building, the floor panel of a first volumetric module also serves as a ceiling panel to a second volumetric module positioned beneath the first volumetric module. In an exemplary embodiment, the floor panel is configured to interact with a façade. In the exemplary embodiment shown, the floor assembly 701 includes a ⅝ inch thick non-combustible floor board 703, a 3 inch deep corrugated metal floor deck 705, a hangar wire to support main runners at 24 inches 707, a fiberglass insulation 709, a dry wall suspension system 711, and two layers of Gypsum board 713.

Figure 8:
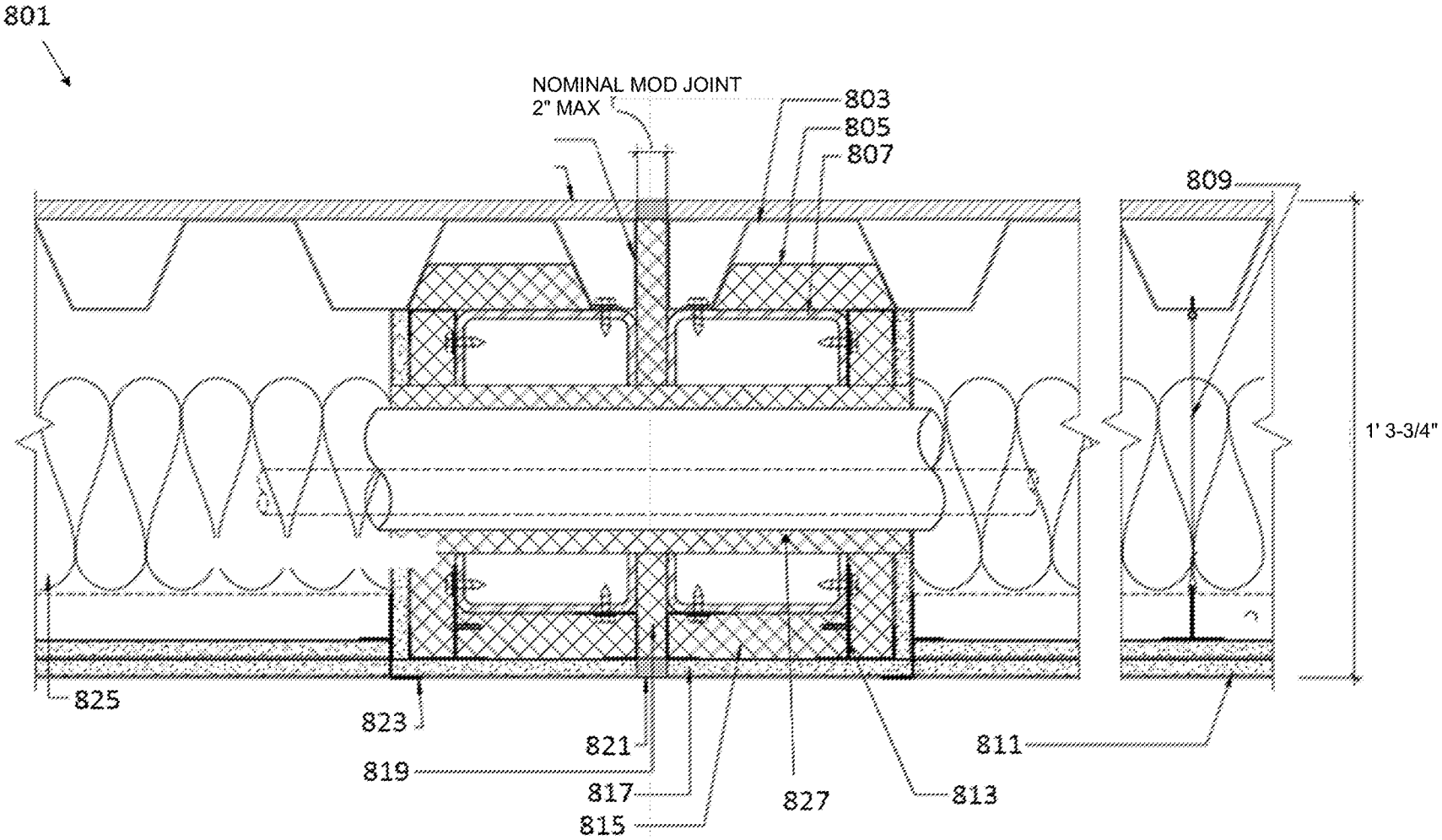
FIG. 8 is a cross-sectional view of an exemplary telescoping duct assembly according to an embodiment.

FIG. 8 depicts an exemplary embodiment of a floor assembly 801 with a telescoping duct 827. The telescoping duct connections may include metallic connections of ducts with flexible connections between modules. A module-to-module flexible duct connection increases the speed and accuracy of manufacture by allowing the duct connections to be moved into place upon assembly. In certain cases, hooks in the duct connection pieces along with flexible connections allow for pre-installation at one end of the connection minimizing site work and disruption to the ceiling. A flexible connection also allows for looser tolerances, thereby making up for inaccuracies in the manufacturing and/or module setting. In the exemplary embodiment shown, the floor assembly 801 includes a metal floor deck 803, flutes above beam filled with mineral wool insulation 805, substructures with 5/16 inches or more wall thickness 807, a hangar wire to support main runners 809, a dry wall suspension system 811, framing members 813, mineral wool insulation 815, a layer of type C gypsum board 817, a cavity between modules filled with mineral wool insulation 819, fire caulk 821, a metal corner bead 823, fiberglass insulation in a joint cavity 825, and a telescoping duct 827. In some embodiments, the telescopic duct 827 consists of a steel sleeved oval duct which is connected from one module to another. The duct locks in place once it reaches the appropriate spot when making a connection.

Figure 9:
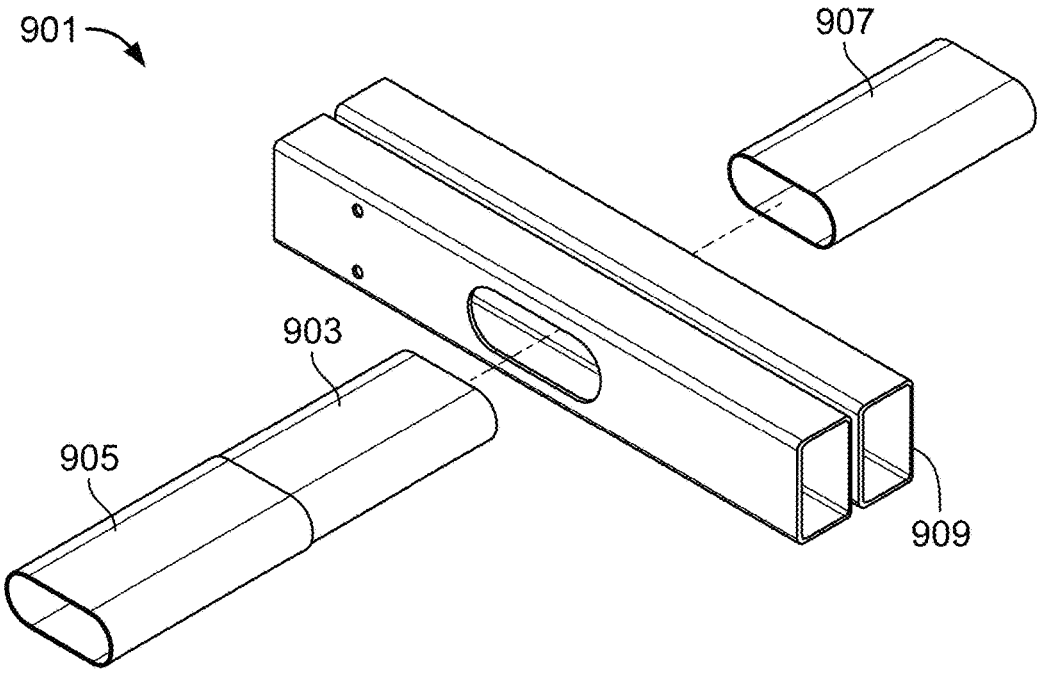
FIG. 9 depicts an exemplary telescoping duct assembly according to an embodiment.

FIG. 9 depicts an exemplary telescoping duct assembly according to an embodiment. In the example shown, the telescope duct assembly 901 includes a telescoping oval duct 903 and an oval duct 905 connected to an intake system. The telescoping oval duct 903 and/or oval duct 905 pass thru one or more beams 909 of a volumetric module. The oval duct 903 and/or oval duct 905 are installed in a larger oval duct 907, which receives the telescoping oval duct 903.

Figure 10:
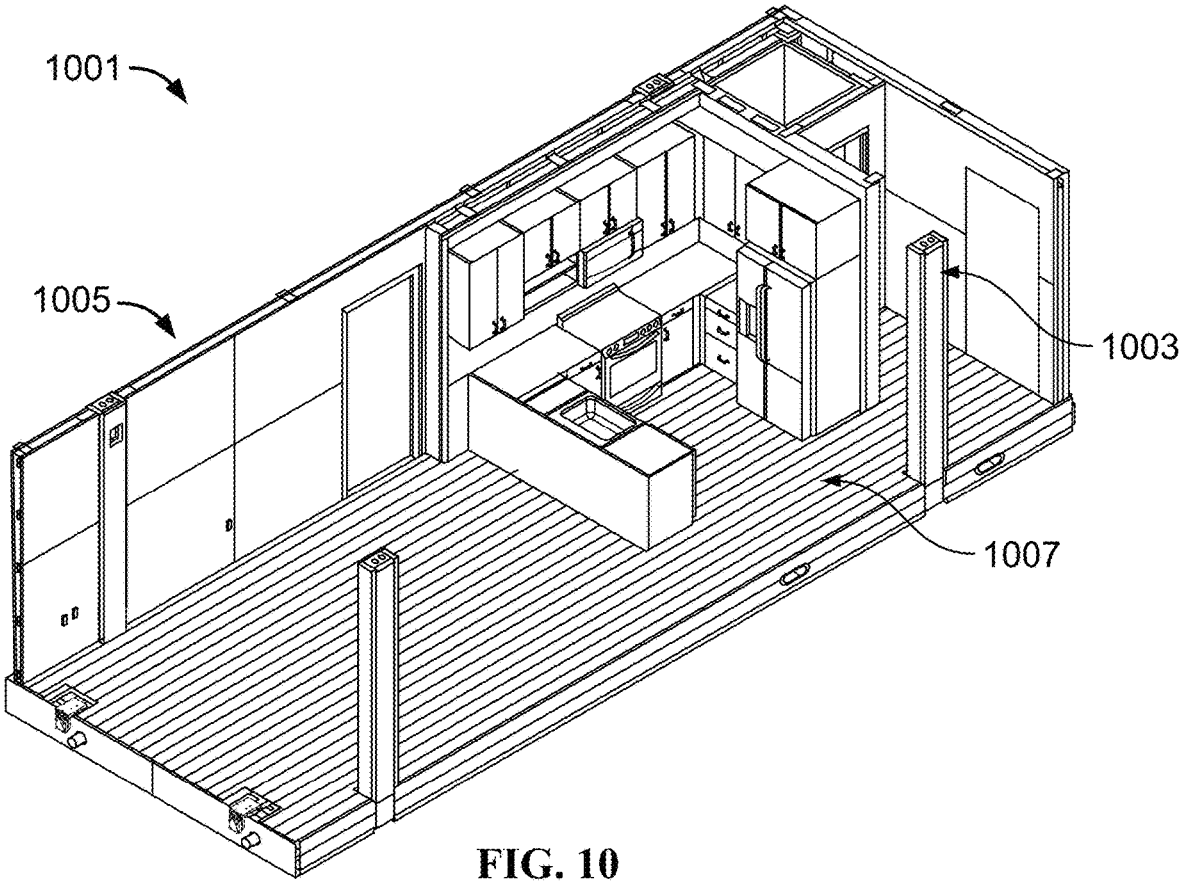
FIG. 10 depicts an exemplary volumetric module according to an embodiment.

FIG. 10 depicts an exemplary volumetric module 1001 according to an embodiment comprising a module chassis 1003, an exterior wall 1005 attached to at least a portion of the module chassis, a floor assembly 1007 attached to at least a portion of the module chassis and a façade (not shown) adjustably attached to at least a portion of said module chassis.

Figure 11:
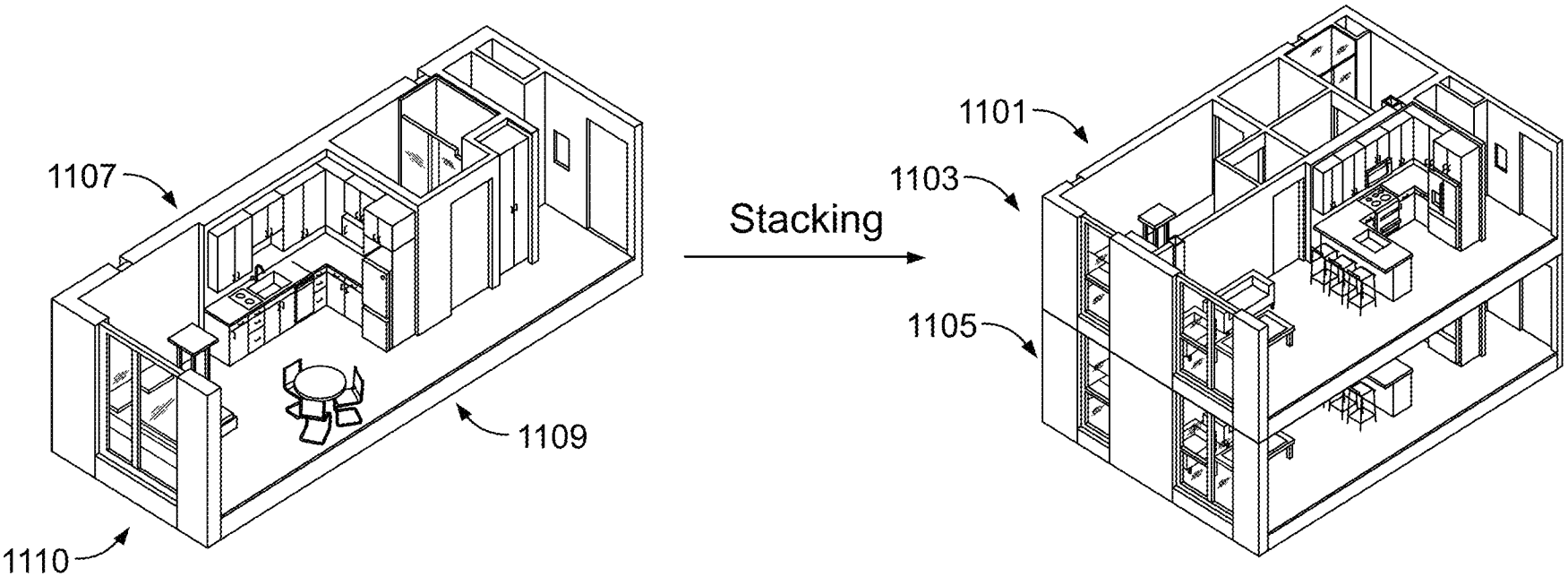
FIG. 11 depicts an exemplary modular space including two volumetric modules stacked on top of one another according to an embodiment.

FIG. 11 depicts a modular space 1101 including two volumetric modules 1103, 1105 stacked on top of one another according to an embodiment. Each of the volumetric modules includes an exterior wall 1107 attached to at least a portion of a module chassis (not shown), a floor assembly 1109 attached to at least a portion of the module chassis and a façade 1110 adjustably attached to at least a portion of said module chassis. As shown, the volumetric modules 1103, 1105 include four walls. At the building site, the modules 1103, 1105 are stacked. In certain cases, each of the four-walled modules does not include a ceiling to conserve material. The floor assembly 1109 of a module 1103 serves as the ceiling of a module 1105 below. Similarly, an exterior wall 1107 of a module 1103 acts as a wall of an adjacent module. At the edges of a building, a façade of the building (not shown) may serve as a wall of the volumetric module

1103, 1105. Assembling a building from modules 1103, 1105 including four walls results in significant material and cost savings.

In various embodiments, the techniques disclosed herein may be used in the fabrication of various structures including, but not limited to, volumetric modular buildings, multi-family modular buildings, single family modular buildings, structural framing for buildings and high-rises. For example, in an exemplary embodiment a modular building is assembled by at least the following steps. First, a plurality of volumetric modules are assembled at a first location. Each of these volumetric modules is made of a module chassis having one, two or three exterior walls and a floor assembly attached to it. These modules also have a façade attached to them (this feature will be elaborated below). The volumetric module has at least one open side and an open top. In addition, the volumetric modules are configured to accept an accommodation module following assembly of the modular building. Next, the volumetric modules are assembled into a frame for the modular building. The dimensions and shape of the frame is predesigned and on-site surveying equipment is used to ensure that adjacent modules are correctly positioned. Adjacent modules are connected at connection points or joints by module-to-module connectors. These module-to-module connectors have eccentric bushings. The eccentric bushings have a "rotatable" core having an opening for a fastening member. This rotatable core ensures that a large hole can be fit with a bolt, which can be rotated to ensure proper alignment with structure of adjacent modules. More specifically, the rotatable openings that allow for an adjustable connection at a connection point or joint between adjacent modules to be made with a fastening member (e.g. a screw, a bolt, a rivet, etc.) and allows for increased tolerance to misalignments between adjacent modules. Once the modules are connected and the frame is completed, the façade of a first module is mated to the façades of adjacent modules such that a flush, water-proof dry-seal is formed giving the modular building a finished look. This feature is made possible by configuring each façade to female and male components for accepting corresponding female and male components of adjacent façades on-site. This also allows for façades to preliminary be pre-fabricated onto modules off-site and subsequently mated to adjacent façades and modules on-site.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A volumetric module comprising:

a module chassis;

an exterior wall attached to at least a portion of said module chassis;

a floor assembly attached to at least a portion of said module chassis;

a bracket assembly attached to the chassis directly adjacent to the floor assembly; and a façade adjustably attached to the module chassis by the bracket assembly, wherein said volumetric module is configured to interface with a second volumetric module including a second module chassis, wherein the bracket assembly comprises a first bracket attached to the façade and a second bracket attached to the module chassis, wherein the module chassis comprises a plurality of horizontal structural members and a plurality of vertical structural members attached to one or more of the plurality of horizontal structural members, and wherein the second bracket is attached to the module chassis in parallel with the floor assembly and directly above a first face of a horizontal structural member of the plurality of horizontal structural members and the first bracket is configured to have translational motion perpendicular to the floor assembly and directly in front of a second face of the horizontal structural member.

2. The volumetric module of claim 1, wherein said bracket assembly is configured to have translational motion along multiple planes in a three-dimensional space.

3. The volumetric module of claim 1, wherein at least three exterior walls are attached to said module chassis.

4. The volumetric module of claim 1, wherein a maximum of three exterior walls are attached to said module chassis, wherein said maximum of three exterior walls are configured such that at least one side of said module chassis remains unobstructed by said maximum of three exterior walls, and wherein said module chassis has an open top portion such that the top portion of said module chassis remains unobstructed.

5. The volumetric module of claim 1, further comprising an interior wall attached to said module chassis.

6. The volumetric module of claim 5, wherein said interior wall forms a doorway.

7. The volumetric module of claim 1, wherein at least one of said exterior wall or said floor assembly comprise a protective material.

8. The volumetric module of claim 7, wherein said protective material is at least one of a fire resistant material and a water proof material.

9. The volumetric module of claim 1, wherein said floor assembly comprises at least one of a joint protective material, a panelized material, a corrugated metal floor deck, and a fiberglass.

10. The volumetric module of claim 1, wherein the façade is a wall.

* * * * *